US008944540B2

(12) United States Patent
Kim et al.

(10) Patent No.: US 8,944,540 B2
(45) Date of Patent: Feb. 3, 2015

(54) SEMI-AUTO CLOSING APPARATUS AND REFRIGERATOR HAVING THE SAME

(71) Applicant: Samsung Electronics Co., Ltd., Suwon (KR)

(72) Inventors: Sung Mo Kim, Ansan (KR); Jong Hoon Oh, Gwangju (KR); Sang Hyuk Kang, Gwangju (KR); Youn Tae Shin, Gwangju (KR); Jae Kyoung Jang, Gwangju (KR); Il Young Jung, Gumi (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/859,401

(22) Filed: Apr. 9, 2013

(65) Prior Publication Data

US 2013/0264930 A1 Oct. 10, 2013

(30) Foreign Application Priority Data

Apr. 10, 2012 (KR) ..... 10-2012-0037439

(51) Int. Cl.
*F25D 23/02* (2006.01)
*E05F 1/00* (2006.01)
*F25D 23/00* (2006.01)

(52) U.S. Cl.
CPC . *E05F 1/00* (2013.01); *F25D 23/00* (2013.01); *F25D 23/028* (2013.01); *F25D 2323/024* (2013.01)
USPC ..... 312/405

(58) Field of Classification Search
CPC ..... F25D 2323/024; F25D 2323/023; F25D 23/028; F25D 23/02; F25D 23/04; E05Y 2900/31
USPC ..... 312/405, 405.1, 326, 329, 321.5; 49/386; 292/23, 194, 195, 1, DIG. 17; 16/49, 50, 71, 78, 82, 312–315, 231
See application file for complete search history.

(56) References Cited

U.S. PATENT DOCUMENTS

| | | | | | |
|---|---|---|---|---|---|
| 1,831,800 | A | * | 11/1931 | Bales et al. | 292/79 |
| 2,611,922 | A | * | 9/1952 | Borman et al. | 16/278 |
| 3,722,937 | A | * | 3/1973 | Stoeckl | 292/79 |
| 3,996,699 | A | * | 12/1976 | Crowe | 49/386 |
| 4,690,468 | A | * | 9/1987 | Lau | 312/291 |

(Continued)

FOREIGN PATENT DOCUMENTS

| | | |
|---|---|---|
| KR | 10-2006-0053217 | 5/2006 |
| KR | 10-2006-0094818 | 8/2006 |
| KR | 10-2007-0065457 | 6/2007 |

*Primary Examiner* — Janet M Wilkens
(74) *Attorney, Agent, or Firm* — Staas & Halsey LLP

(57) ABSTRACT

A refrigerator which improves the structure of an auto closing apparatus, increases the sealing ability of a door, and omits mounting of a separate spring. The refrigerator includes at least one door opening and closing at least one storage chamber provided in a main body, at least one upper hinge module including a body part and an extension part rotatably coupled to the at least one door, at least one lower hinge module, a door cap installed on an upper portion of the at least one door and including a hinge receiving part, an auto close lever coupled to the door cap and has elasticity to transmit elastic force to the door, and a cam member including a cam surface contacting the auto close lever so that the auto close lever accumulates elastic force and then transmits the elastic force to the door when the door is closed.

20 Claims, 10 Drawing Sheets

(56) References Cited

U.S. PATENT DOCUMENTS

| | | | | | |
|---|---|---|---|---|---|
| 4,817,240 | A * | 4/1989 | Sovis et al. | 16/297 |
| 5,522,656 | A * | 6/1996 | Jenkins | 292/79 |
| 5,579,606 | A * | 12/1996 | Kim | 49/386 |
| 5,896,619 | A * | 4/1999 | Koopman | 16/50 |
| 5,931,554 | A * | 8/1999 | Koopman | 312/405 |
| 5,975,663 | A * | 11/1999 | Becker | 312/405 |
| 7,748,080 | B2 * | 7/2010 | Hottmann | 16/72 |
| 7,753,459 | B2 * | 7/2010 | Kappler et al. | 312/333 |
| 7,992,951 | B2 * | 8/2011 | Kim et al. | 312/405 |
| 8,506,026 | B2 * | 8/2013 | Kim et al. | 312/405 |
| 2010/0231110 | A1 * | 9/2010 | Choi | 312/405 |
| 2014/0009057 | A1 * | 1/2014 | Chen et al. | 312/405 |

* cited by examiner

SEMI-AUTO CLOSING APPARATUS AND REFRIGERATOR HAVING THE SAME

CROSS-REFERENCE TO RELATED APPLICATIONS

This application claims the benefit of Korean Patent Application No. 10-2012-0037439, filed on Apr. 10, 2012 in the Korean Intellectual Property Office, the disclosure of which is incorporated herein by reference.

BACKGROUND

1. Field

Embodiments of the present disclosure relate to a semi-auto closing apparatus and a refrigerator having the same.

2. Description of the Related Art

In general, a refrigerator includes storage chambers and a cold air supply apparatus supplying cold air to the storage chambers, and thus stores foods in a fresh state.

The insides of the storage chambers maintain temperatures, each of which is within a designated range, required to store foods in the fresh state.

The front portions of such storage chambers of the refrigerator are opened, and the opened front portions are closed by doors to maintain the temperatures of the insides of the storage chambers at normal times.

The plurality of storage chambers are divided by diaphragms, and among the plural storage chamber, a refrigerating chamber provided in the upper portion of the refrigerator is opened and closed by two doors rotatably hinged to a main body of the refrigerator and a freezing chamber provided in the lower portion of the refrigerator is opened and closed by a drawer-type door sliding in the forward and backward directions.

A refrigerating chamber door opening and closing the refrigerating chamber is opened and closed by an auto closing apparatus, and the auto closing apparatus includes an auto close lever mounted on an upper hinge, a cam member fixed to the upper portion of the refrigerating chamber door, and a spring transmitting elastic force to the refrigerating chamber door so as to close the refrigerating chamber door.

Since the auto close lever is mounted on the upper hinge, the auto close lever is protruded to the outside, and may thus spoil the external appearance of the refrigerator.

Further, since the spring transmitting elastic force to the refrigerating chamber door is separately provided, the configuration of the auto closing apparatus is complicated and the cost of the auto closing apparatus is raised.

SUMMARY

Therefore, it is an aspect of the present disclosure to provide a refrigerator which improves the structure of an auto closing apparatus opening and closing a door so as to improve quality, to increase the sealing ability of the door, and to omit mounting of a separate spring.

Additional aspects of the disclosure will be set forth in part in the description which follows and, in part, will be obvious from the description, or may be learned by practice of the disclosure.

In accordance with one aspect of the present disclosure, a refrigerator includes a main body, at least one storage chamber having an opened front portion and provided in the main body, at least one door opening and closing the at least one storage chamber, at least one upper hinge module including a body part and installed on an upper portion of the main body, and an extension part extended from the body part to the at least one door and rotatably coupled to the at least one door, at least one lower hinge module installed on a lower portion of the main body and rotatably coupled to the at least one door, a door cap installed on the upper portion of the at least one door and including a hinge receiving part in which the extension part of the at least one upper hinge module is received, an auto close lever installed on the door cap so as to be received in the hinge receiving part, and having elasticity to transmit elastic force to the at least one door in the closing direction of the at least one door when the at least one door is closed, and a cam member installed on the extension part of the at least one upper hinge module, and including a cam surface contacting the auto close lever so that the auto close lever accumulates elastic force and transmits the elastic force to the at least one door when the at least one door is closed.

The at least one upper hinge module may further includes an upper hinge including the body part and the extension part, a combining member fixed to the main body and coupling the body part of the upper hinge with the main body, and a hinge shaft rotatably coupling the extension part of the upper hinge The at least one upper hinge module may further includes a hinge cover provided at the front portion of the upper portion of the main body and covers the upper portion of the at least one upper hinge module so as to prevent exposure of the at least one upper hinge module to the outside.

A protrusion part is protruded at the rear portion of the body part, and a fixing part into which the protrusion part is inserted, may be provided on the combining member.

A first through hole, through which the hinge shaft passes, may be provided on the extension part, a second through hole is provided on the at least one door cap at a position corresponding to the first through hole, and the at least one door is rotatably coupled to the main body by inserting the hinge shaft into the first through hole and the second through hole.

A combining part with which the cam member is installed, may be provided on the extension part, and the cam member is detachably installed on the combining part.

A first fastening hole to which the auto close lever is fastened, may be provided on the hinge receiving part of the door cap, and a second fastening hole to which the auto close lever is fastened to the first fastening hole by a fastening member, may be provided on the auto close lever.

The hinge receiving part may be provided with a plurality of protrusions, fixing the auto close lever to prevent movement of the auto close lever, and a support part to prevent sagging of the auto close lever.

The auto close lever may be bent in a C or U shape so as to have elasticity, one portion of the auto close lever is fastened to the hinge receiving part by the fastening member, and a roller contacting the cam surface of the cam member and moving along the shape of the cam surface when the at least one door is closed, may be provided on the other portion of the auto close lever.

The cam surface includes an inflection point serving as a reference point when the at least one door is opened and closed, and a first contact surface and a second contact surface provided below and above the inflection point so as to be inclined in opposite directions based on the inflection point.

The roller moves sequentially while contacting the first contact surface, the inflection point and the second contact surface of the cam surface during the closing process of the at least one door.

The auto close lever may accumulate elastic force before the roller passes through the inflection point after contacting the first contact surface, and transmits the elastic force to the at least one door in the closing direction of the at least one door while the roller passes through the inflection point and contacts the second contact surface, during the closing process of the at least one door.

In accordance with another aspect of the present disclosure, a refrigerator which has a main body, at least one storage chamber having an opened front portion and provided in the main body, and at least one door rotatably coupled to the main body and opening and closing the at least one storage chamber, the refrigerator comprising: at least one upper hinge module installed on the main body, the upper hinge module including a hinge shaft rotatably coupled with the at least one door, at least one lower hinge module installed on the main body and rotatably coupled to a lower portion of the at least one door, a door cap, installed on upper portion of the at least one door and including a hinge receiving part in which a portion of the at least one upper hinge module is received, an auto close lever, having elasticity, installed on the door cap so as to be received in the hinge receiving part, and provided with a roller at one portion thereof, and a cam member, installed on the at least one upper hinge module, and includes a first contact surface inclined upward in the leftward direction, a second contact surface extended upward in the rightward direction in an arc shape from the first contact surface, and an inflection point provided between the first contact surface and the second contact surface, wherein the auto close lever accumulates elastic force before the roller passes through the inflection point after contacting the first contact surface, and closes the at least one door by the accumulated elastic force while the roller passes through the inflection point and contacts the second contact surface, during the closing process of the at least one door.

The at least one upper hinge module may further includes an upper hinge including a body coupled to the main body and an upper hinge extending from the body to the at least one door, received in the hinge receiving part and rotatably coupled to the at least one door by the hinge shaft, and a combining member fixed to the main body and coupling the body part of the upper hinge with the main body, and the hinge shaft rotatably coupling the extension part of the upper hinge with the at least one door.

A protrusion part is protruded at the rear portion of the body part, and a fixing part into which the protrusion part is inserted, may be provided on the combining member.

A first through hole, through which the hinge shaft passes, may be provided on the extension part, a second through hole may be provided on the door cap at a position corresponding to the first through hole, and the at least one door may be rotatably coupled to the main body by inserting the hinge shaft into the first through hole and the second through hole.

A first fastening hole to which the auto close lever is fastened may be provided on the hinge receiving part of the door cap, and a second fastening hole to which the auto close levers is fastened to the first fastening hole by a fastening member, may be provided on the auto close lever.

The hinge receiving part may be provided with a plurality of protrusions fixing the auto close levers to prevent movement of the auto close levers, and a support part to prevent sagging of the auto close levers.

In accordance with another aspect of the present disclosure, a refrigerator comprising: a main body, at least one storage chamber having an opened front portion, provided in the main body, at least one door opening and closing the at least one storage chamber, at least one upper hinge module, including a body part installed on the main body, and an extension part extended from the body part to the at least one door and rotatably coupled to the at least one door, at lest one lower hinge module installed on the main body and rotatably coupled to a lower portion of the at least one door, a door cap installed on the upper portion of the at least one door and including a hinge receiving part in which the extension part of the at least one upper hinge module is received, an auto close lever installed on the door cap so as to be received in the hinge receiving part, and having elasticity to transmit elastic force to the at least one door in the closing direction of the at least one door when the at least one door is closed, and a cam member installed on the extension part of the at least one upper hinge module, and including a cam surface contacting the auto close lever so that the auto close lever accumulates elastic force and transmits the elastic force to the at least one door when the at least one door is closed, wherein: the at least one upper hinge module further includes an upper hinge including the body part and the extension part, a combining member fixed to the main body and coupling the body part of the upper hinge with the main body, and a hinge shaft rotatably coupling the extension part of the upper hinge with the at least one door, a first through hole, through which the hinge shaft passes, is provided on the extension part, a second through hole is provided on the door cap at a position corresponding to the first through hole, and the corresponding door is rotatably coupled to the main body by inserting the hinge shaft into the first through hole and the second through hole, and a roller contacting the cam surface of the cam member and moving along the shape of the cam surface when the at least one door is closed, is provided on the auto close lever.

In accordance with a further aspect of the present disclosure, a semi-auto closing apparatus transmitting force to a door rotatably coupled to a refrigerator main body by an upper hinge module in the closing direction of the door when the door is closed, the semi-auto closing apparatus comprising: an auto close lever having elasticity, installed on an upper portion of the door, and provided with a roller at one portion thereof, and a cam member installed on the upper hinge module, and having a cam surface including a first contact surface inclined upward in the leftward direction, a second contact surface extended upward in the rightward direction in an arc shape from the first contact surface, and an inflection point provided between the first contact surface and the second contact surface, wherein the auto close lever accumulates elastic force before the roller passes through the inflection point after contacting the first contact surface, and closes the door by the accumulated elastic force while the roller passes through the inflection point and contacts the second contact surface, during the closing process of the door.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
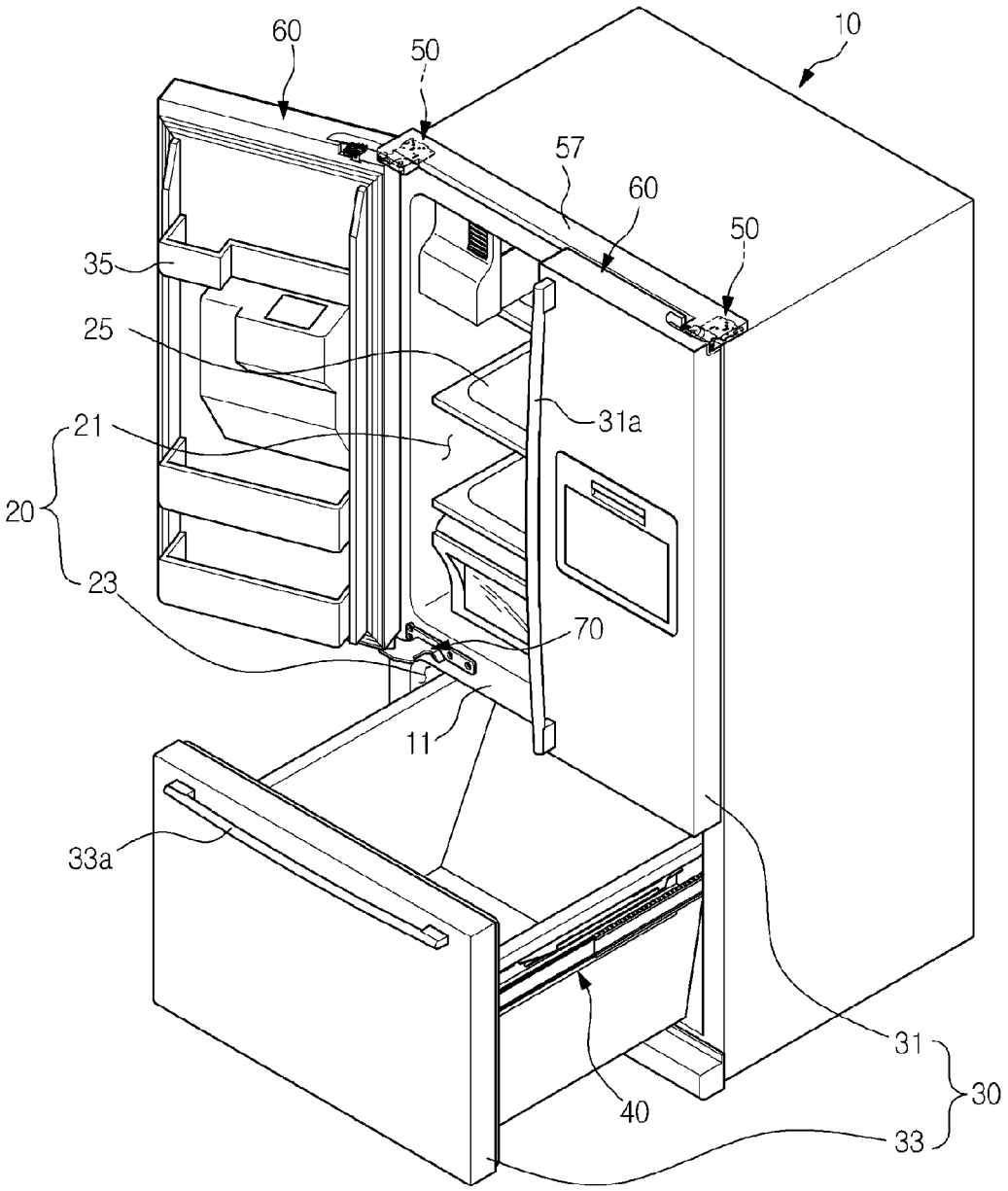
FIG. 1 is a perspective view of a refrigerator in accordance with an embodiment of the present disclosure.

Reference will now be made in detail to embodiments of the present disclosure, examples of which are illustrated in the accompanying drawings, wherein like reference numerals refer to like elements throughout.

As shown in FIG. 1, a refrigerator in accordance with an embodiment of the present disclosure includes a main body 10, storage chambers 20, each of which is provided with an opened front portion, provided in the main body 10, doors 30 opening and closing the storage chambers 20, a sliding apparatus 40 causing a freezing chamber door 33 opening and closing a freezing chamber 23 and provided in the lower portion of the main body 10 among the storage chambers 20 to be slidably installed with the main body 10, upper hinge modules 50 causing refrigerating chamber doors 31 opening and closing a refrigerating chamber 32 and provided in the upper portion of the main body 10 among the storage chambers 20 to be rotatably installed on the main body 10, lower hinge modules 70 installed on the main body 10 and rotatably coupled to a lower portion of the refrigerating chamber doors 31, door caps 60 installed on the upper portions of the refrigerating chamber doors 31, and semi-auto closing apparatuses 100 transmitting force to the refrigerating chamber doors 31 in a direction of closing the refrigerating chamber doors 31 when the refrigerating chamber doors 31 are closed. Further, the refrigerator may include a main body, at least one storage chamber, at least one door, at least one upper hinge module, at least one lower hinge module, a door cap, an auto close lever, and a cam member.

As shown in FIG. 1, the main body 10 includes an inner case (not shown) forming the storage chambers 20, an outer case (not shown) forming the external appearance of the main body 10, and a cold air supply apparatus (not shown) supplying cold air to the storage chambers 20.

The cold air supply apparatus may include a compressor, a condenser, an expansion valve, an evaporator, an air blower fan and a cold air duct, and a foamed thermal insulating material is provided between the inner case and the outer case of the main body 10 so as to prevent cold air leakage from the storage chambers 20.

A machine chamber (not shown) in which the compressor compressing a refrigerant and the condenser condensing the compressed refrigerant are installed is provided in the lower area of the rear portion of the main body 10.

The storage chambers 20 are vertically divided by a diaphragm 11. That is, the refrigerating chamber 21 is provided in the upper portion of the main body 10, and the freezing chamber 23 is provided in the lower portion of the main body 10. However, the refrigerating chamber may be provided in the lower portion of the main body and the freezing chamber may be provided in the upper portion of the main body.

The freezing chamber 23 is opened and closed by the freezing chamber door 33 slidably installed with the main body 10, and the sliding apparatus 40 is coupled with the freezing chamber door 33 and both side walls of the inside of the freezing chamber 23 so that the freezing chamber door 33 may slide with respect to the main body 10.

A handle 33*a* gripped by a user so as to open and close the freezing chamber door 33 is provided on the freezing chamber door 33.

A plurality of racks 25 may be provided within the refrigerating chamber 21 to divide the refrigerating chamber 21 into a plurality of sections.

The refrigerating chamber 21 is opened and closed by the refrigerating chamber doors 31 rotatably coupled to the main body 10, and the upper hinge modules 50 are coupled to the upper portion of the main body 10 so as to rotatably coupling the refrigerating chamber doors 31 with the main body 10.

The door caps 60 may be installed on the upper portions of the refrigerating chamber doors 31, and a plurality of guards 35 receiving food may be installed on the rear surfaces of the refrigerating chamber doors 31.

In the same manner as the freezing chamber door 33, a handle 31*a* gripped by a user so as to open and close the refrigerating chamber doors 31 is provided on the refrigerating chamber doors 31.

Figure 2:
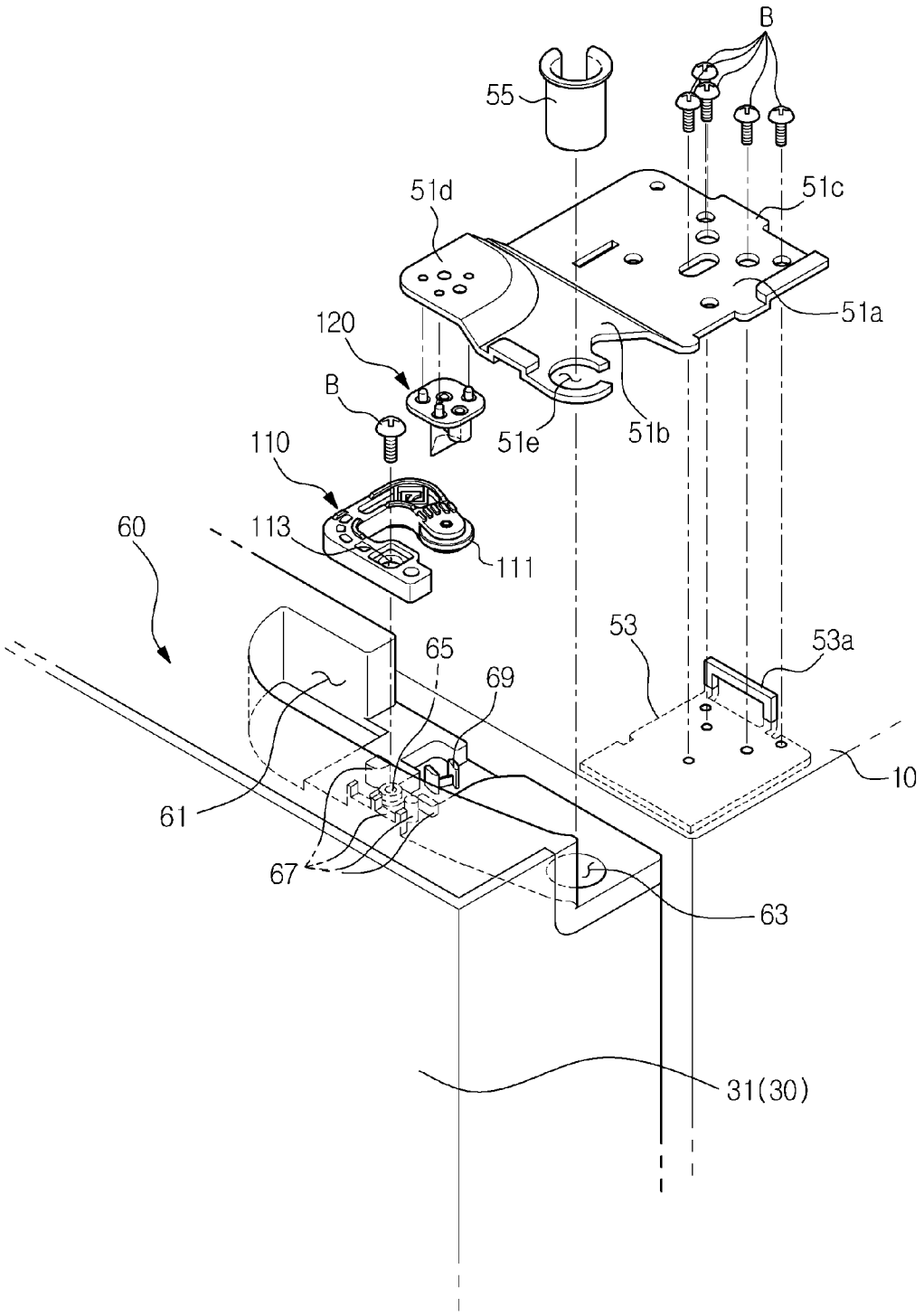
FIG. 2 is an exploded perspective view illustrating combination of an auto close lever and a cam member with an upper hinge module and a door cap in accordance with an embodiment of the present disclosure.

As shown in FIG. 2, an upper hinge module 50 rotatably coupling the refrigerating chamber door 31 with the main body 10 includes an upper hinge 51, a combining member 53 fixed to the upper portion of the main body 10 and coupling the upper hinge 51 with the main body 10, and a hinge shaft 55 rotatably coupling the upper hinge 51 and the refrigerating chamber door 31 with each other so that the refrigerating chamber door 31 is rotatably coupled to the main body 10.

The upper hinge 51 includes a body part 51*a* coupled to the main body 10, and an extension part 51*b* extended from the body part 51*a* to the refrigerating chamber door 31 and rotatably coupled to the refrigerating chamber door 31.

A protrusion part 51*c* protruded at the rear portion of the body part 51*a* and inserted into a fixing part 53*a* of the combining member 53 which will be described later.

The extension part 51*b* is provided with a combining part 51*d* with which a cam member 120 of the semi-auto closing apparatus 100 which will be described later is installed, and a first through hole 51*e* through which the hinge shaft 55 rotatably coupling the extension part 51*b* and the refrigerating chamber door 31 with each other passes.

The hinge shaft 55 having passed through the first through hole 51*e* passes through a second through hole 63 of the door cap 60 installed on the upper portion of the refrigerating chamber door 31.

The combining member 53 is fixed to the upper portion of the main body 10, and is fastened to the body part 51*a* of the upper hinge 51 by fastening members B so as to couple the upper hinge 51 with the main body 10.

The fixing part 53*a* into which the protrusion part 51*c* of the upper hinge 51 is inserted is provided at the rear portion of the combining member 53, thus fixing the upper hinge 51 to the combining member 53 before the upper hinge 51 is fastened to the combining member 53.

The hinge shaft 55 is rotatably coupled with the upper portion of the refrigerating chamber door 31 so as to pass through the first through hole 51*e* of the upper hinge 51 and the second through hole 63 of the door cap 60, thereby rotatably coupling the refrigerating chamber door 31 with the main body 10.

The upper hinge module 50 may further include a hinge cover 57 provided at the front portion of the upper portion of the main body 10 and covering the upper portion of the upper hinge module 50 so as to prevent exposure of the upper hinge module 50 to the outside.

Figure 3:
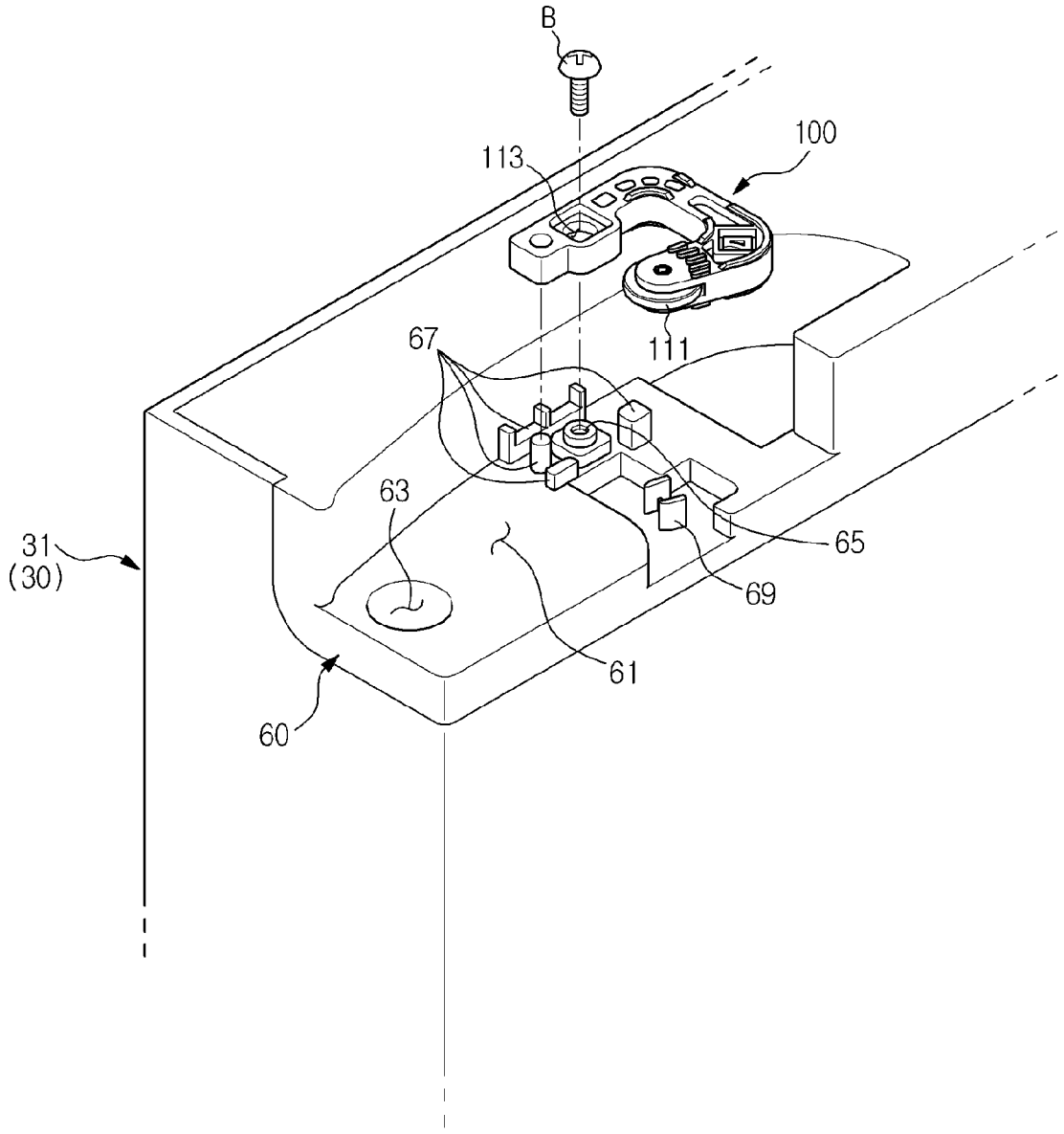
FIG. 3 is a view illustrating combination of the auto close lever to the door cap in accordance with an embodiment of the present disclosure.

As shown in FIGS. 2 and 3, the door cap 60 is installed on the upper portion of the refrigerating chamber door 31, and includes a hinge receiving part 61 in which the extension part 51*b* of the upper hinge 51 is received.

The second through hole 63 through which the hinge shaft 55 passes is provided on the hinge receiving part 61 at a position corresponding to the first through hole 51*e* provided on the extension part 51*b* of the upper hinge 51 received in the hinge receiving part 61.

An auto close lever 110 contacting the cam member 120 installed with the upper hinge 51 and transmitting force to the refrigerating chamber door 31 in a direction of closing of the refrigerating chamber door 31 when the refrigerating chamber door 31 is closed is coupled to the hinge receiving part 61.

In order to fasten the auto close lever 110 to the hinge receiving part 61, a first fastening hole 65 is provided on the hinge receiving part 61, and a second fastening hole 113 is provided on the auto close lever 110. After the first fastening hole 65 and the second fastening hole 113 are aligned with each other, the auto close lever 110 is fastened to the hinge receiving part 61 using a fastening member B.

Further, a plurality of protrusions 67 to prevent movement of the auto close lever 110 fastened to the hinge receiving part 61 may be provided on the hinge receiving part 61 and, in order to prevent sagging of the auto close lever 110 formed of an elastic material, a support part 69 supporting one portion of the auto close lever 110 may be provided.

Figure 4:
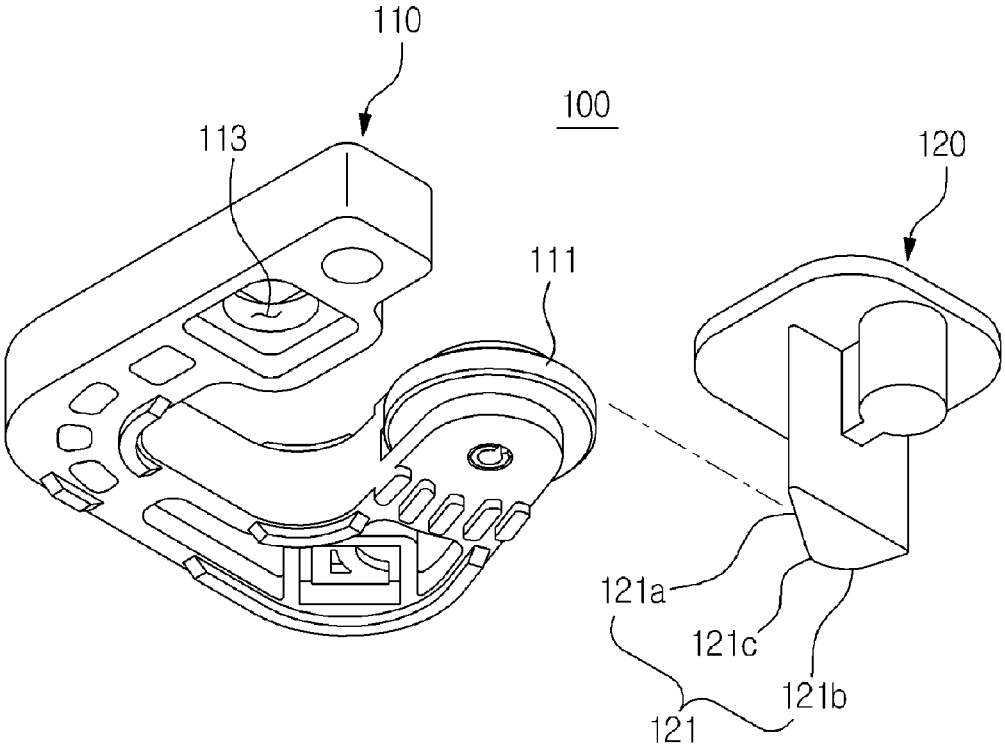
FIG. 4 is a view illustrating a semi-auto closing apparatus in accordance with an embodiment of the present disclosure.

As shown in FIGS. 2 to 4, a semi-auto closing apparatus 100, transmitting force to the refrigerating chamber door 31 in the direction of closing of the refrigerating chamber door 31 when the refrigerating chamber door 31 rotatably coupled to the main body 10 is closed, is coupled to the upper hinge module 50 and the door cap 60.

The semi-auto closing apparatus 100 includes the auto close lever 110 formed of the elastic material and coupled to the door cap 60 installed on the upper portion of the refrigerating chamber door 31, and the cam member 120 coupled to the upper hinge module 50 and contacting the auto close lever 110.

The second fastening hole 113 to fasten the auto close lever 110 to the door cap 60 by the fastening member B is provided on the auto close lever 110, and fastening between the auto close lever 110 and the door cap 60 is described above and a detailed description thereof will thus be omitted.

The auto close lever 110 is bent in a C or U shape so as to have elasticity, one portion of the auto close lever 110 is fastened to the hinge receiving part 61 by the fastening member B, and a roller 111 contacting a cam surface 121 of the cam member 120 which will be described later is provided on the other portion of the auto close lever 110.

The roller 111 maintains a non-contact state with the cam surface 121 of the cam member 120 in a state in which the refrigerating chamber door 31 is completely opened and, when the refrigerating chamber door 31 is closed to some degree, the roller 111 contacts the cam surface 121, then moves along the shape of the cam surface 121, and the auto close lever 110 accumulates elastic force and then transmits the accumulated elastic force in the direction of closing the refrigerating chamber door 31 so as to close the refrigerating chamber door 31.

A process of closing the refrigerating chamber door 31 by the auto close lever 110 will be described later.

The cam member 120 is detachably coupled to the combining part 51*d* provided on the extension part 51*b* of the upper hinge 51, and is provided with the cam surface 121 contacting the roller 111 of the auto close lever 110.

Figure 5:
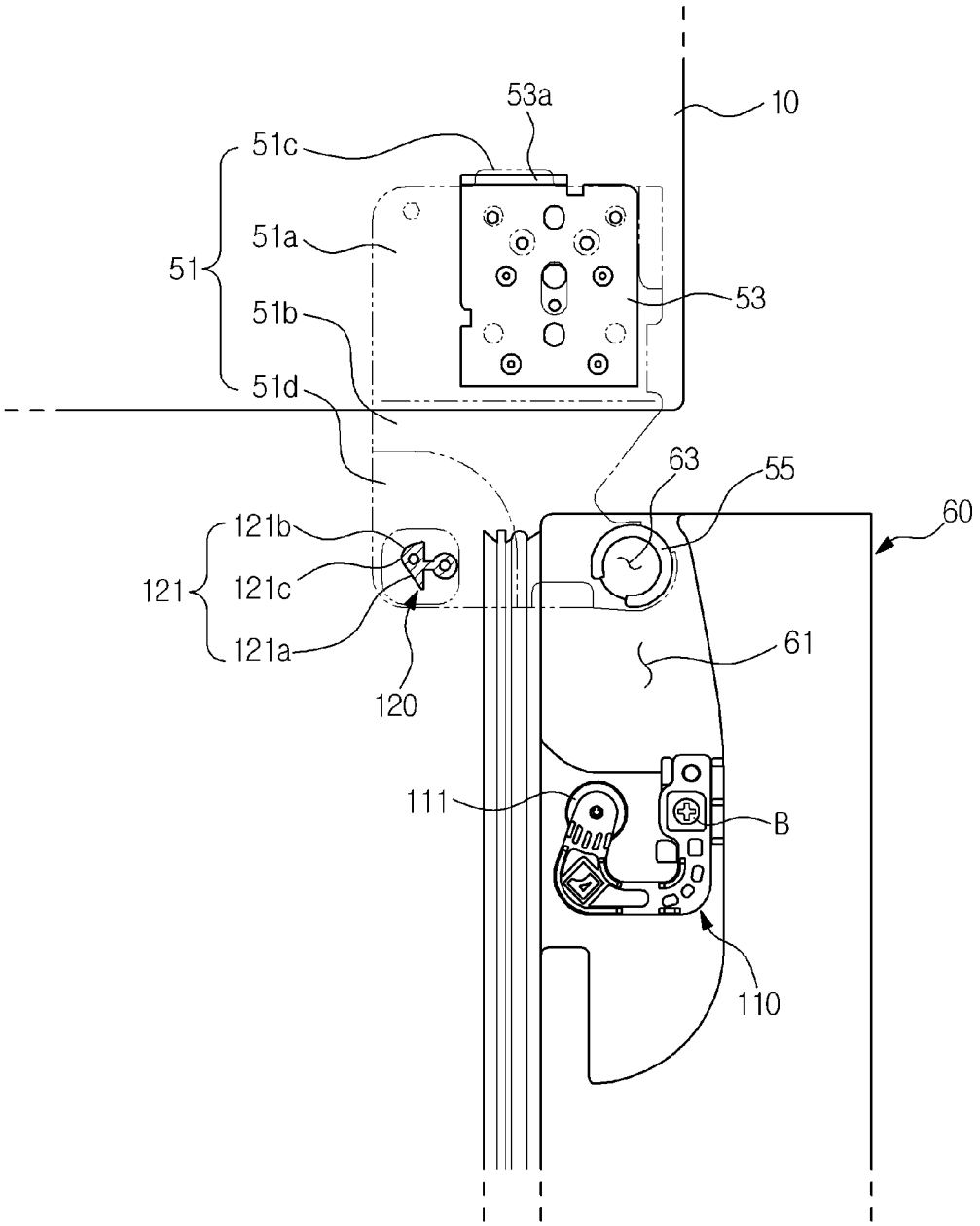
FIGS. 5 to 10 are views illustrating an operation of closing a refrigerating chamber door by the semi-auto closing apparatus in accordance with an embodiment of the present disclosure.

The cam surface 121 includes a first contact surface 121*a* inclined upward in the leftward direction as seen from FIGS. 4 and 5 a second contact surface 121*b* extended from the first contact surface 121*a* in an arc shape upward in the rightward direction, and an inflection point 121*c* provided between the first contact surface 121*a* and the second contact surface 121*b*.

The roller 111 of the auto close lever 110 maintains the non-contact state with the cam surface 121 of the cam member 120 in the state in which the refrigerating chamber door 31 is completely opened and, when the refrigerating chamber door 31 is closed to some degree, the roller 111 contacts the first contact surface 121*a* of the cam surface 121.

The roller 111 contacting the first contact surface 121*a* moves and accumulates elastic force while sequentially contacting the first contact surface 121*a*, the inflection point 121*c* and the second contact surface 121*b* during the closing process of the refrigerating chamber door 31, and transmits elastic force to the refrigerating chamber door 31 in the direction of closing the refrigerating chamber door 31, thereby closing the refrigerating chamber door 31.

Next, with reference to FIGS. 5 to 10 (viewed from the top of the refrigerator), the operating process of the semi-auto closing apparatus 100 will be described.

As shown in FIG. 5, in the completely opened state of the refrigerating chamber door 31, the auto close lever 110 of the auto closing apparatus 100 maintains the non-contact state with the cam surface 121 of the cam member 120.

Figure 6:
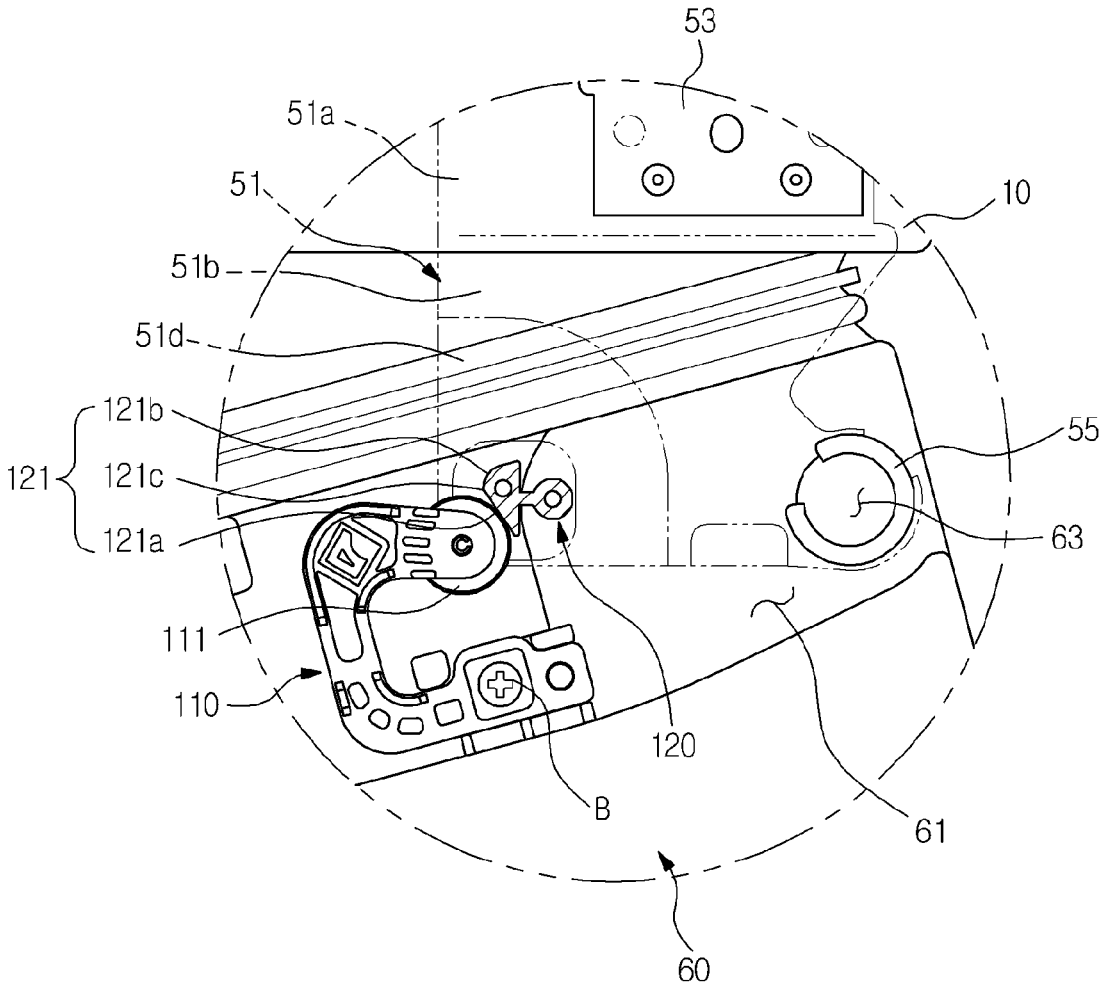

In the completely opened state of the refrigerating chamber door 31, when the refrigerating chamber door 31 is closed to some degree, as shown in FIG. 6, the roller 111 of the auto close lever 110 contacts the cam surface 121 of the cam member 120.

Figure 7:
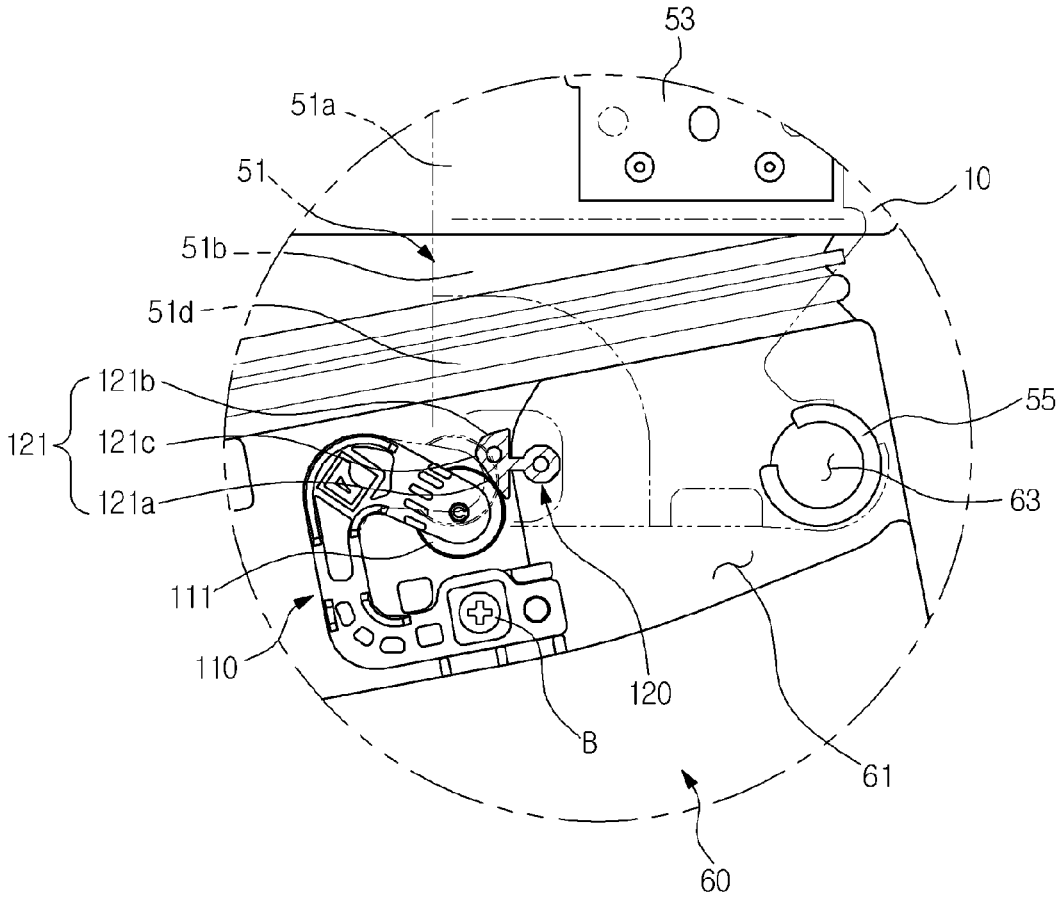

First, the roller 111 contacts the first contact surface 121*a* of the cam surface 121. In the contact state of the roller 111 with the first contact surface 121*a*, when the refrigerating chamber door 31 is pushed in the direction of closing the refrigerating chamber door 31, as shown in FIG. 7, the roller 111 moves downward from the first contact surface 121*a*, and then the auto close lever 110 having elasticity accumulates elastic force.

Figure 8:
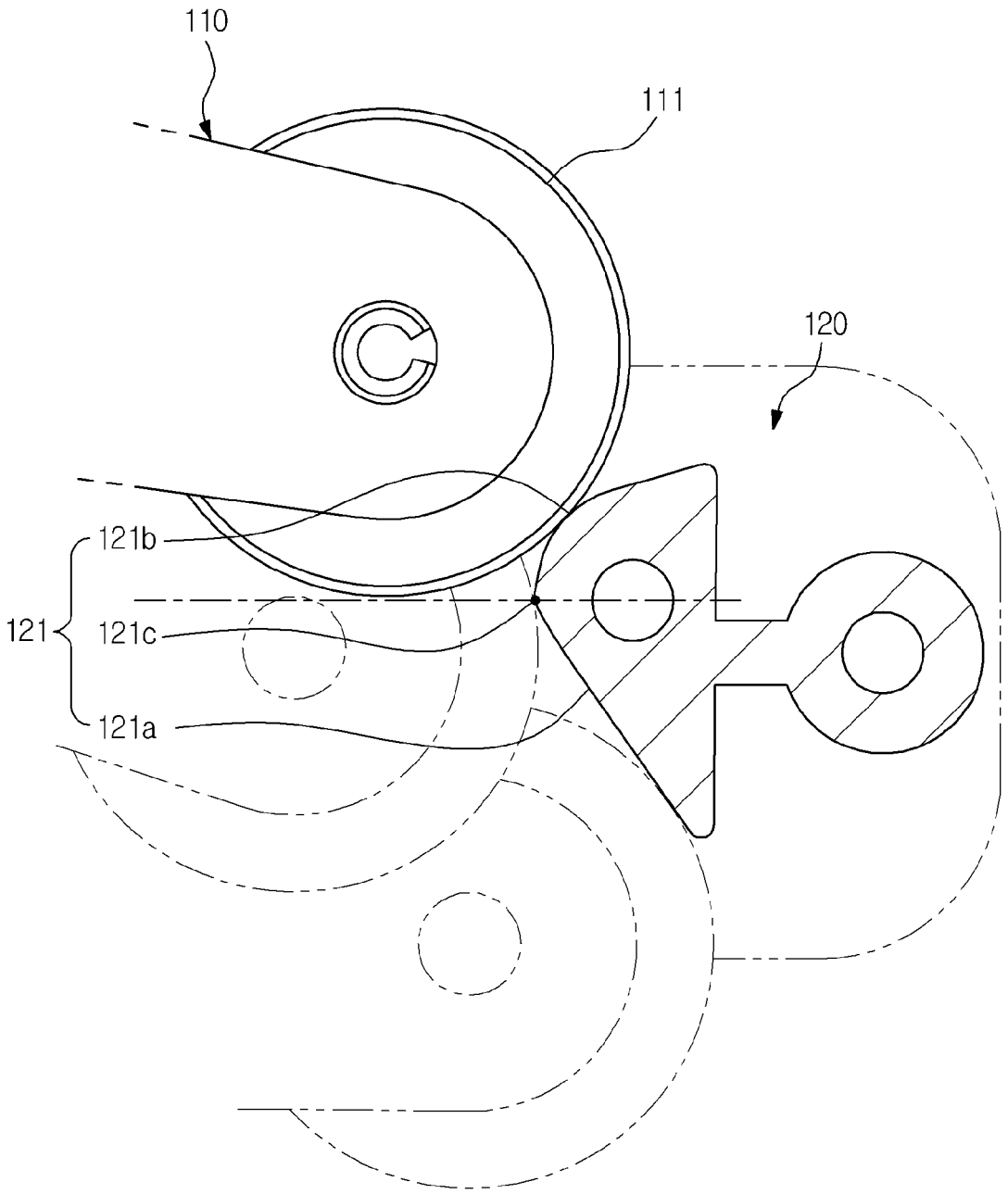
Figure 9:
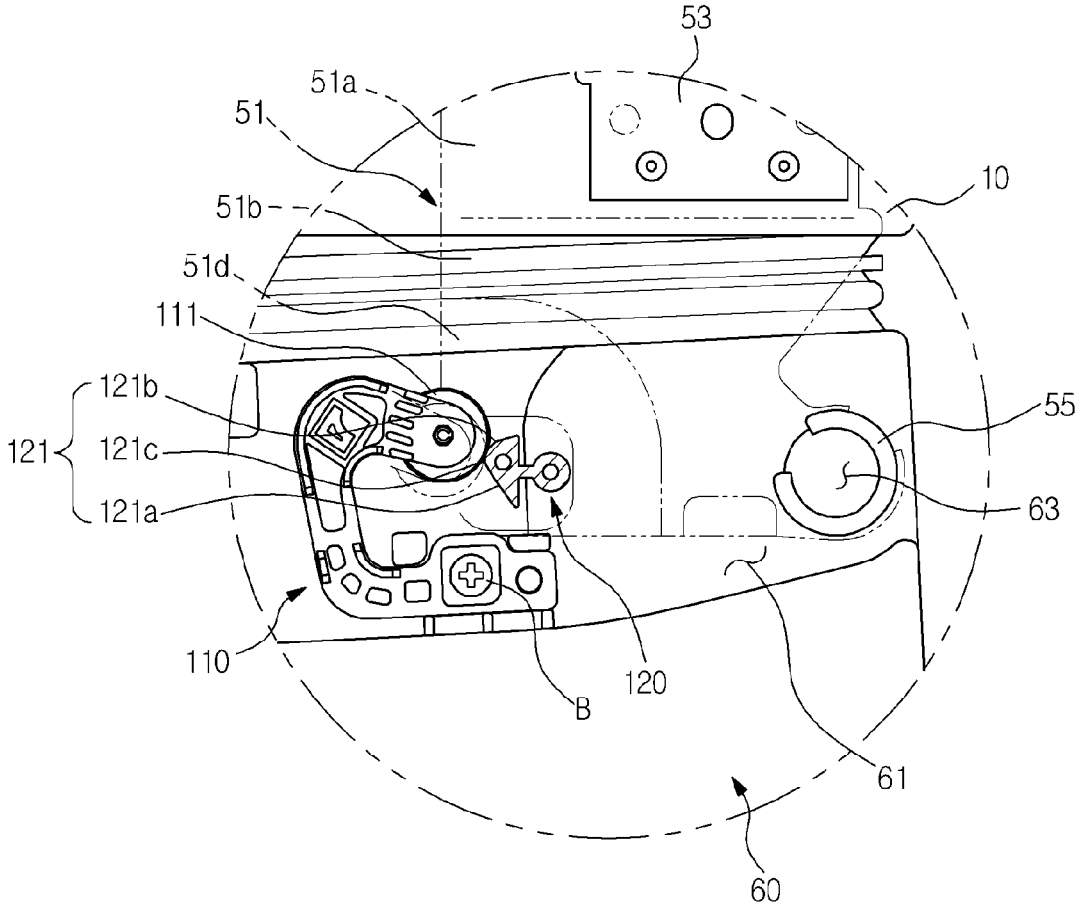

In the state in which the auto close lever 110 accumulates elastic force, when the refrigerating chamber door 31 is pushed even more in the direction of closing the refrigerating chamber door 31, the roller 111 moves in the upward direction along the first contact surface 121*a* of the cam surface 121, and thus moves to the second contact surface 121*b* via the inflection point 121*c*, as shown in FIGS. 8 and 9.

Figure 10:
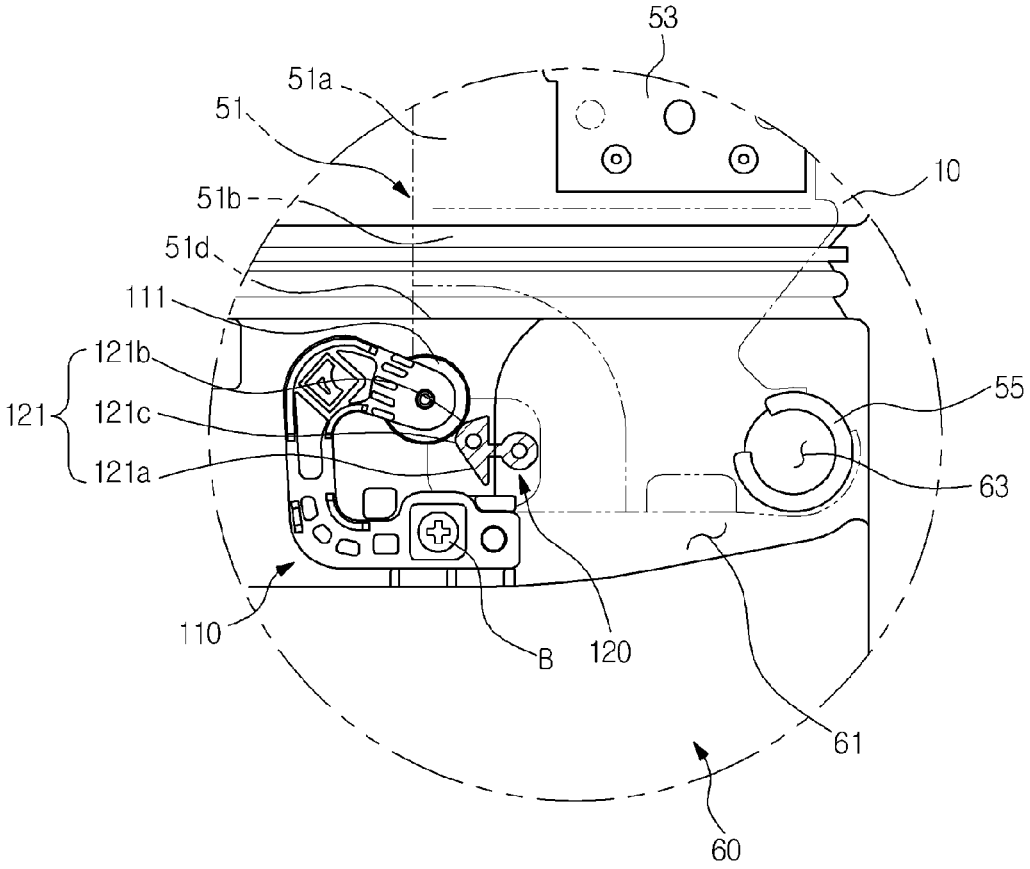

As the roller 111 moves to the second contact surface 121*b* of the cam surface 121, the roller 111 is supported by the second contact surface 121*b*, the auto close lever 110 transmits accumulated elastic force to the refrigerating chamber door 31, and the refrigerating chamber door 31 is completely closed by the transmitted elastic force, as shown in FIG. 10.

When the refrigerating chamber door 31 is closed, the refrigerating chamber door 31 receives the remaining elastic force of the auto close lever 110 in the direction of closing the refrigerating chamber door 31, and thus maintains the completely sealed state.

Although not shown in the drawings, when the refrigerating chamber door 31, a non-limiting example, is opened, the roller 111 moves sequentially while contacting the second contact surface 121*b*, the inflection point 121*c* and the first contact surface 121*a* of the cam surface 121. Since the refrigerating chamber door 31 maintains the closed state before the roller 11 passes through the inflection point 121*c*, the refrigerating chamber door 31 is not opened and maintains the closed state when the other refrigerating chamber door 31 is opened or closed.

As is apparent from the above description, a semi-auto closing apparatus and a refrigerator having the same in accordance with an embodiment of the present disclosure improve quality of the semi-auto closing apparatus, increase the sealing ability of a door, and have the simple structure of the semi-auto closing apparatus so as to achieve cost reduction.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body;

at least one storage chamber having an opened front portion and provided in the main body;

at least one door opening and closing the at least one storage chamber;

at least one upper hinge module including a body part and installed on an upper portion of the main body, and an extension part extended from the body part to the at least one door and rotatably coupled to the at least one door;

at least one lower hinge module installed on a lower portion of the main body and rotatably coupled to the at least one door;

a door cap installed on the upper portion of the at least one door and including a hinge receiving part in which the extension part of the at least one upper hinge module is received;

an auto close lever installed on the door cap so as to be received in the hinge receiving part, and having elasticity to transmit elastic force to the at least one door in a closing direction of the at least one door when the at least one door is closed; and a cam member installed on the extension part of the at least one upper hinge module, and including a cam surface contacting the auto close lever so that the auto close lever accumulates elastic force and transmits the elastic force to the at least one door when the at least one door is closed.

2. The refrigerator according to claim 1, wherein the at least one upper hinge module further includes an upper hinge including the body part and the extension part, a combining member fixed to the main body and coupling the body part of the upper hinge with the main body, and a hinge shaft rotatably coupling the extension part of the upper hinge.

3. The refrigerator according to claim 2, wherein the at least one upper hinge module further includes a hinge cover provided at a front portion of the upper portion of the main body and covers the upper portion of the at least one upper hinge module so as to prevent exposure of the at least one upper hinge module to the outside.

4. The refrigerator according to claim 2, wherein a protrusion part is protruded at a rear portion of the body part, and a fixing part into which the protrusion part is inserted, is provided on the combining member.

5. The refrigerator according to claim 2, wherein a first through hole, through which the hinge shaft passes, is provided on the extension part, a second through hole is provided on the door cap at a position corresponding to the first through hole, and the at least one door is rotatably coupled to the main body by inserting the hinge shaft into the first through hole and the second through hole.

6. The refrigerator according to claim 5, wherein a combining part with which the cam member is installed, is provided on the extension part, and the cam member is detachably installed on the combining part.

7. The refrigerator according to claim 1, wherein a first fastening hole to which the auto close lever is fastened, is provided on the hinge receiving part of the door cap, and a second fastening hole to which the auto close lever is fastened to the first fastening hole by a fastening member, is provided on the auto close lever.

8. The refrigerator according to claim 7, wherein the hinge receiving part is provided with a plurality of protrusions, fixing the auto close lever to prevent movement of the auto close lever, and a support part to prevent sagging of the auto close lever.

9. The refrigerator according to claim 1, wherein the auto close lever is bent in a C or U shape so as to have elasticity, one portion of the auto close lever is fastened to the hinge receiving part by a fastening member, and a roller contacting the cam surface of the cam member and moving along the shape of the cam surface when the at least one door is closed, is provided on the other portion of the auto close lever.

10. The refrigerator according to claim 9, wherein the cam surface includes an inflection point serving as a reference point when the at least one door is opened and closed, and a first contact surface and a second contact surface provided below and above the inflection point so as to be inclined in opposite directions based on the inflection point.

11. The refrigerator according to claim 10, wherein the roller moves sequentially while contacting the first contact surface, the inflection point and the second contact surface of the cam surface during a closing process of the at least one door.

12. The refrigerator according to claim 11, wherein the auto close lever accumulates elastic force before the roller passes through the inflection point after contacting the first contact surface, and transmits the elastic force to the at least one door in a closing direction of the at least one door while the roller passes through the inflection point and contacts the second contact surface, during the closing process of the at least one door.

13. A refrigerator which has a main body, at least one storage chamber having an opened front portion and provided in the main body, and at least one door rotatably coupled to the main body and opening and closing the at least one storage chamber, the refrigerator comprising:

at least one upper hinge module installed on the main body, the upper hinge module including a hinge shaft rotatably coupled with the at least one door;

at least one lower hinge module installed on the main body and rotatably coupled to a lower portion of the at least one door;

a door cap, installed on upper portion of the at least one door and including a hinge receiving part in which a portion of the at least one upper hinge module is received;

an auto close lever, having elasticity, installed on the door cap so as to be received in the hinge receiving part, and provided with a roller at one portion thereof; and a cam member, installed on the at least one upper hinge module, and includes a first contact surface inclined upward in the leftward direction, a second contact surface extended upward in the rightward direction in an arc shape from the first contact surface, and an inflection point provided between the first contact surface and the second contact surface, wherein the auto close lever accumulates elastic force before the roller passes through the inflection point after contacting the first contact surface, and closes the at least one door by the accumulated elastic force while the roller passes through the inflection point and contacts the second contact surface, during a closing process of the at least one door.

14. The refrigerator according to claim 13, wherein:

the at least one upper hinge module further includes an upper hinge including a body part coupled to the main body and an extension part extending from the body part to the at least one door, received in the hinge receiving part and rotatably coupled to the at least one door by the hinge shaft, and a combining member fixed to the main body and coupling the body part of the upper hinge with the main body; and the hinge shaft rotatably coupling the extension part of the upper hinge with the at least one door.

15. The refrigerator according to claim 14, wherein a protrusion part is protruded at a rear portion of the body part, and a fixing part into which the protrusion part is inserted, is provided on the combining member.

16. The refrigerator according to claim 14, wherein a first through hole, through which the hinge shaft passes, is provided on the extension part, a second through hole is provided on the door cap at a position corresponding to the first through hole, and the at least one door is rotatably coupled to the main body by inserting the hinge shaft into the first through hole and the second through hole.

17. The refrigerator according to claim 13, wherein a first fastening hole to which the auto close lever is fastened is provided on the hinge receiving part of the door cap, and a second fastening hole to which the auto close levers is fastened to the first fastening hole by a fastening member, is provided on the auto close lever.

18. The refrigerator according to claim 17, wherein the hinge receiving part is provided with a plurality of protrusions fixing auto close levers to prevent movement of the auto close levers, and a support part to prevent sagging of the auto close levers.

19. A refrigerator comprising:

a main body;

at least one storage chamber having an opened front portion, provided in the main body;

at least one door opening and closing the at least one storage chamber;

at least one upper hinge module, including a body part installed on the main body, and an extension part extended from the body part to the at least one door and rotatably coupled to the at least one door;

at least one lower hinge module installed on the main body and rotatably coupled to a lower portion of the at least one door;

a door cap installed on an upper portion of the at least one door and including a hinge receiving part in which the extension part of the at least one upper hinge module is received;

an auto close lever installed on the door cap so as to be received in the hinge receiving part, and having elasticity to transmit elastic force to the at least one door in a closing direction of the at least one door when the at least one door is closed; and a cam member installed on the extension part of the at least one upper hinge module, and including a cam surface contacting the auto close lever so that the auto close lever accumulates elastic force and transmits the elastic force to the at least one door when the at least one door is closed, wherein:

the at least one upper hinge module further includes an upper hinge including the body part and the extension part, a combining member fixed to the main body and coupling the body part of the upper hinge with the main body, and a hinge shaft rotatably coupling the extension part of the upper hinge with the at least one door;

a first through hole, through which the hinge shaft passes, is provided on the extension part, a second through hole is provided on the door cap at a position corresponding to the first through hole, and the corresponding door is rotatably coupled to the main body by inserting the hinge shaft into the first through hole and the second through hole; and a roller contacting the cam surface of the cam member and moving along the shape of the cam surface when the at least one door is closed, is provided on the auto close lever.

20. A semi-auto closing apparatus transmitting force to a door rotatably coupled to a refrigerator main body by an upper hinge module in a closing direction of the door when the door is closed, the semi-auto closing apparatus comprising:

an auto close lever having elasticity, installed on an upper portion of the door, and provided with a roller at one portion thereof; and a cam member installed on the upper hinge module, and having a cam surface including a first contact surface inclined upward in the leftward direction, a second contact surface extended upward in the rightward direction in an arc shape from the first contact surface, and an inflection point provided between the first contact surface and the second contact surface, wherein the auto close lever accumulates elastic force before the roller passes through the inflection point after contacting the first contact surface, and closes the door by the accumulated elastic force while the roller passes through the inflection point and contacts the second contact surface, during a closing process of the door.

* * * * *